US005899785A

United States Patent [19]

Groten et al.

[11] Patent Number: 5,899,785

[45] Date of Patent: May 4, 1999

[54] NONWOVEN LAP FORMED OF VERY FINE CONTINUOUS FILAMENTS

[75] Inventors: Robert Groten; Jean Baravian, both of Sundhoffen; Georges Riboulet, Colmar, all of France

[73] Assignee: Firma Carl Freudenberg, Weinheim, Germany

[21] Appl. No.: 08/877,111

[22] Filed: Jun. 17, 1997

[30] Foreign Application Priority Data

Jun. 17, 1996 [FR] France ..... P 9607659

[51] Int. Cl.[6] ..... D04H 1/00

[52] U.S. Cl. ..... 442/334; 442/335; 442/337; 442/338; 442/352; 442/361; 442/387; 442/389

[58] Field of Search ..... 428/373, 374, 428/397, 398; 442/335, 337, 338, 327, 334, 352, 353, 361, 387, 389

[56] References Cited

U.S. PATENT DOCUMENTS 3,531,368 9/1970 Okamoto et al. ..... 161/175

4,560,385 12/1985 Baravian ..... 8/115.7

5,225,263 7/1993 Baravian et al. ..... 428/95

*Primary Examiner*—James J. Bell

*Attorney, Agent, or Firm*—Kenyon & Kenyon

[57] ABSTRACT

A nonwoven lap of very fine continuous filaments, crimped or not, obtained by means of a controlled direct spinning process, with a weight between 5 g/m$^2$ and 600 g/m$^2$, and formed, after napping, of composite filaments separable in the direction of their length, characterized in that said composite filaments have a filament number between 0.3 dTex and 10 dTex and are formed, each, of at least three elementary filaments of at least two different materials and comprising between them at least one plane of separation or cleavage, each elementary filament having a filament number between 0.005 dTex and 2 dTex, the ratio between the cross-sectional area of each elementary filament and the total cross-sectional area of the unitary filament being between 0.5% and 90%.

21 Claims, 3 Drawing Sheets

NONWOVEN LAP FORMED OF VERY FINE CONTINUOUS FILAMENTS

BACKGROUND OF THE INVENTION

1. Field of the Invention

The present invention relates to the domain of textile products and their applications, and its object is a nonwoven lap of very fine continuous filaments or microfilaments.

The present invention is especially intended to broaden the traditional field of application of nonwovens by conferring upon them physical properties and characteristics, more particularly textile and mechanical, similar to those of woven and knit textile products, while preserving the advantageous properties and characteristics of continuous filament nonwovens.

2. Description of Related Art

Synthetic textile fibers exist, generally designated by the term "Shin-Gosen," whose feel and appearance are very similar to natural fibers.

These known fibers are obtained by spinning techniques that can be used to obtain ultrafine fibers or microfibers of various thickness and of variable polymeric makeup. After spinning, these fibers are transformed by known techniques of weaving or knitting and are treated by more or less complex techniques of dyeing and finishing.

SUMMARY OF THE INVENTION

An object of the present invention is to obtain nonwoven products having characteristics and properties that are at least equal to those of woven or knit products obtained from the aforementioned ultrafine fibers, while applying manufacturing techniques that are clearly more efficient and less costly, resulting in greater flexibility in terms of the variability of the nature and properties of the filaments, methods of consolidation, and properties of the products obtained.

To this end the present invention has as its object a nonwoven lap of continuous filaments, crimped or not, obtained by means of a direct controlled spinning process, with a weight between 5 g/m$^2$ and 600 g/m$^2$, and formed, after napping, of longitudinally separable composite filaments, characterized in that said composite filaments have a filament number (i.e., titer, yarn count) between 0.3 dTex and 10 dTex, and are each formed of at least three elementary filaments and at least two different materials, and comprise among them at least a plane of separation or cleavage, each elementary filament having a filament number between 0.005 dTex and 2 dTex, with the ratio of the cross-sectional area of each elementary filament to the total cross-sectional area of the unitary filament being between 0.5% and 90%.

The invention will be better understood by means of the following description, which relates to preferred embodiments given as non-limiting examples and explained with reference to the attached schematic drawings, in which FIGS. 1 to 7 represent cross-sections of the continuous composite filaments consistent with the invention, prior to separation into elementary filaments.

DETAILED DESCRIPTION OF THE DRAWINGS

Figure 1:
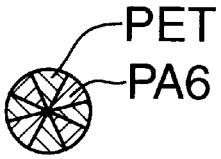
Figure 2:
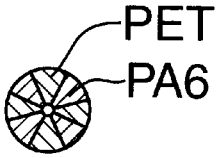
Figure 3:
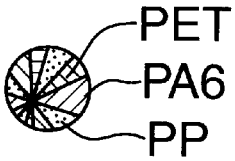

FIGS. 1 to 7 represent cross-sections of the continuous composite filaments of the invention, prior to separation into elementary filaments. In FIGS. 1–3 "PET" is polyethylene terephthalate, "PA6" is polyamide 6, "PP" is polypropylene; and "PBT" is polybutylene terephthalate.

Figure 8:
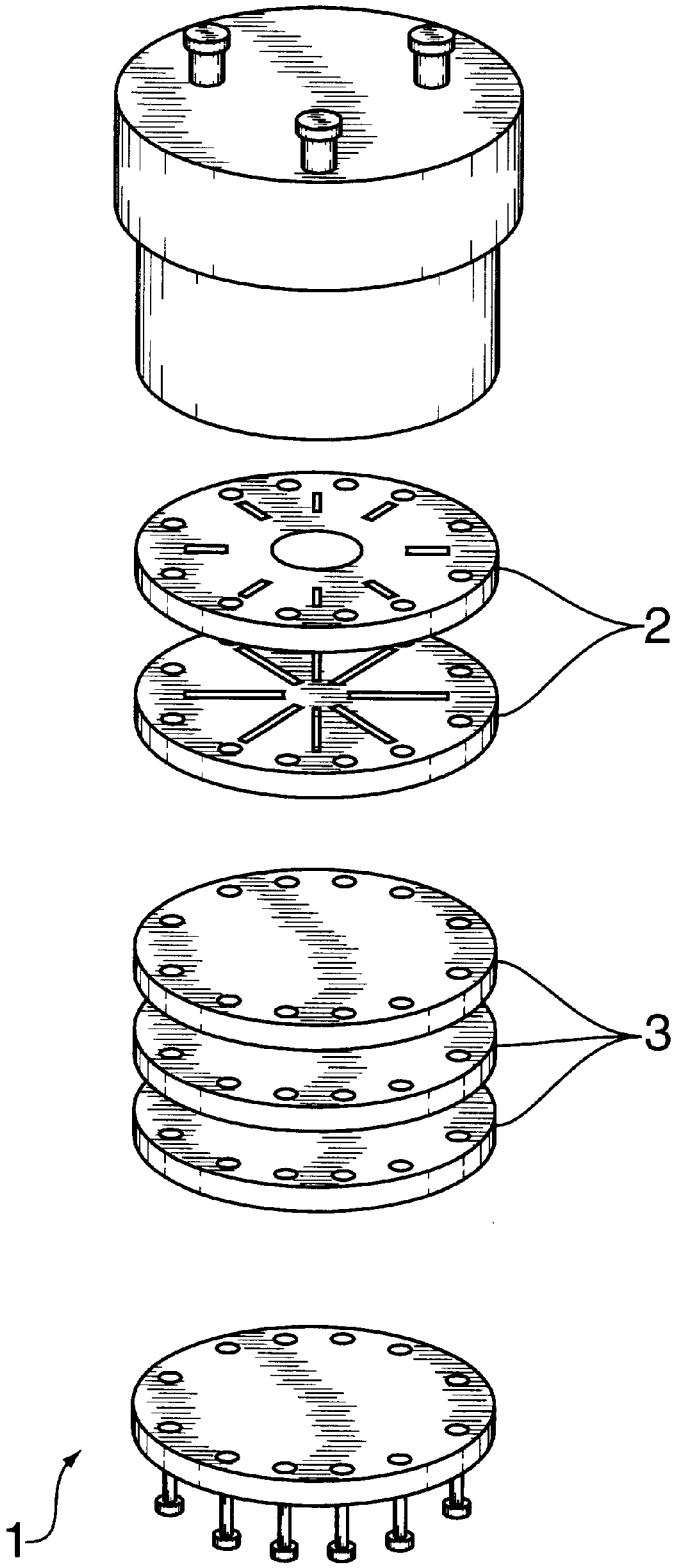

FIG. 8 shows spinning unit 1 consisting of two chambers, two distribution plates 2 (intended to mix the flow from the two chambers) and three plates 3 (intended for distribution itself).

Figure 9:
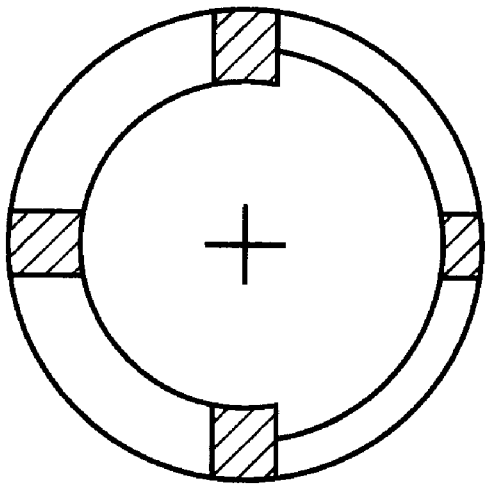
Figure 10:
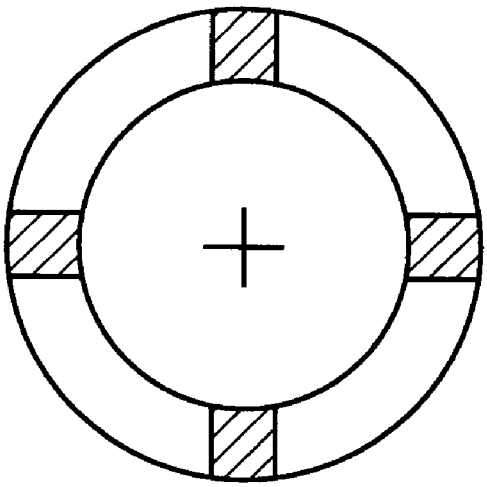

FIGS. 9 and 10 are schematic representations of an orifice of the dies discussed hereinbelow in Examples 1 and 3.

DETAILED DESCRIPTION OF THE INVENTION

In general the invention concerns a nonwoven lap of continuous filaments, crimped or not, obtained by means of a controlled direct spinning process, having a weight between 5 g/m$^2$ and 600 g/m$^2$ , and formed, after napping, of separable composite filaments.

Consistent with the invention, said composite filaments have a filament number between 0.3 dTex and 10 dTex, and are each formed of at least three elementary filaments of at least two different materials, comprising among them at least a plane of separation or cleavage, each elementary filament having a filament number between 0.005 dTex and 2 dTex, with the ratio of the cross-sectional area of each elementary filament to the total cross-sectional area of the unitary filament being between 0.5% and 90%.

Preferentially, the composite filaments have a filament number greater than 0.5 dTex and each elementary filament has a filament number less than 0.5 dTex.

According to a preferred embodiment of the invention, the composite filaments have a filament number between 0.6 dTex and 3 dTex, and the elementary filaments have a filament number between 0.02 dTex and 0.5 dTex.

On the basis of the number of elementary filaments, we can designate the lap obtained as being a nonwoven lap of continuous microfilaments.

Preferentially, the nonwoven lap is, following the controlled operations of extrusion/spinning, drawing/cooling, and napping, subject, simultaneously or successively, to bonding and consolidation operations by mechanical means, such as intense needle punching, the action of pressurized streams of fluid, ultrasound and/or mechanical friction, thermal means, such as boiling water, steam, or microwaves, or chemical means, such as treatment by swelling chemical agents acting upon at least one of the materials constituting the composite filaments, the composite filaments being at least partially separated into their elementary filaments during the course of said operations of bonding and consolidation.

As shown in the attached drawings, the different polymer materials forming the composite filaments are distributed into distinct zones when the latter are viewed in cross-section, in such a way as to permit their separation into elementary filaments, each corresponding, when viewed in cross-section, to one of said zones.

To permit easy separation of the composite filaments into elementary filaments, while enabling direct initial contact between said elementary filaments to form said composite filaments, the different polymer materials constituting the composite filaments are preferentially immiscible and/or incompatible among themselves because of their nature or following treatment of at least one of said polymer materials.

According to a preferred embodiment of the invention, the group of polymer materials forming the elementary filaments is selected from among the following groups: (polyester/polyamide), (polyamide/polyolefin), (polyester/polyolefin), (polyurethane/polyolefin), (polyester/polyester modified by at least one additive), (polyamide/polyamide modified by an additive), (polyester/polyurethane), (polyamide/polyurethane), (polyester/polyamide/polyolefin), (polyester/polyester modified by at least one additive/polyamide), (polyester/polyurethane/polyolefin/polyamide).

Consistent with a first variant embodiment of the invention, more particularly represented in FIGS. 1 to 4 of the attached drawings, the composite filaments present, in cross-section, a configuration of the zones representing the cross-sections of the different elementary filaments in the form of wedges or triangular sections.

Said wedges or sections, which form the cross-sectional pattern of the composite elements, may have different dimensions, thus generating, after disconnection and separation of the initial composite filaments, elementary filaments of clearly different filament numbers.

To promote separation of the composite elements into elementary filaments, said composite filaments may contain a hollow longitudinal tubular cavity, centered or not with respect to the median axis of said composite filaments.

In effect, this arrangement can be used to eliminate close contact between the edges of the elementary filaments formed by the inside angles of the wedges or sections before separation of the composite filaments and contact between different elementary filaments made of the same polymer material.

Figure 4:
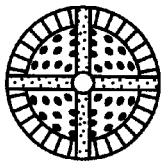
Figure 5:
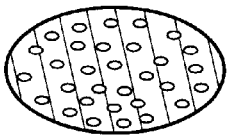

According to a second variant embodiment of the invention, represented in FIGS. 4 and 5 of the attached drawings, the elementary filaments are integrated in a surrounding matrix of a material that is easily separable or dissolvable, the material of said matrix also being present in the interstices separating said elementary filaments or replaced by another polymer material that is dissolvable or incompatible with the polymer material forming the elementary filaments (see FIG. 3).

In this case the outlines of the cross-sections of the elementary filaments can be irregular and notably appear as wedges or sections, the surrounding matrix forming the receiving compartments of said wedges or sections along with an external envelope surrounding all of said wedges or sections (see FIG. 4).

Figure 6:
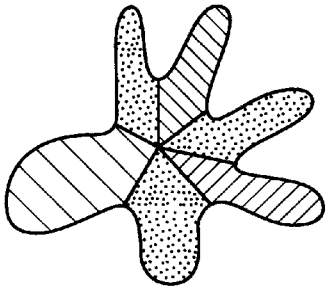
Figure 7:
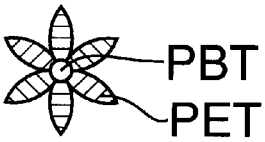

Consistent with a third variant embodiment of the invention, represented in FIGS. 6 and 7 of the attached drawings, the outside contours of the cross-sections of the composite filaments present a multi-lobe configuration, defining several sectors or zones, each corresponding to an elementary filament.

According to an especially preferred characteristic of the invention, the elementary filaments present, in cross-section, a configuration in the shape of a daisy, whose pistil is formed by an elementary filament and whose petals are formed by the other elementary filaments, each of which forms said composite filaments.

To further consolidate the structure of the nonwoven lap, the composite filaments may present a latent or spontaneous crimp resulting from an asymmetry in the behavior of said filaments with respect to their median longitudinal axis, said crimp being activated or accentuated, where appropriate, by an asymmetry in the geometry of the configuration of the cross-section of said composite filaments.

In a variant, the composite filaments may present a latent or spontaneous crimp resulting from a differentiation of the physical properties of the polymer materials forming the elementary filaments during the operations of spinning, cooling and/or drawing of the composite filaments, resulting in distortions generated by the asymmetric internal constraints along the longitudinal median axis of said composite filaments, said crimp being activated or accentuated, where appropriate, by an asymmetry in the geometry of the cross-sectional configuration of said composite filaments.

The composite filaments may present a latent crimp that is activated by thermal, mechanical, or chemical treatment prior to formation of the nonwoven lap.

The crimp can be accentuated by an additional treatment of the lap, consolidated or not, that is, either thermal (tunnel oven, boiling water, steam, hot cylinder, microwaves, infrared) or chemical, with the possible controlled shrinkage of the lap.

To further consolidate the nonwoven lap, the elementary filaments can first be heavily entangled, during or following the division of composite filaments, by mechanical means (needle punching, pressurized streams of fluid) acting principally in a direction perpendicular to the plane of the lap.

The initial composite filaments may be obtained, for example, by electrostatic, mechanical and/or pneumatic (a combination of at least two of these types of deflection is possible) deflection, and projection against a conveyor belt, and mechanically entangled by needle punching (on one or two sides with needles and under perforation conditions that are adequate with respect to the required properties of the nonwoven lap), or by the action of pressurized streams of fluid, charged or not with solid microparticles, possibly after calendering.

Consistent with an embodiment of the invention, the lap is composed of several stacked nonwoven layers.

According to a first variant embodiment, each layer consists of filaments from a single die.

Consistent with a second variant embodiment, at least one layer consists of filaments from at least two distinct dies, said filaments being blended during the drawing phase, before napping.

Similarly, at least one of the layers constituting said lap may be constituted by means of filaments that differ from those of at least one other of said constituent layers.

The operations of entanglement and separation of the composite filaments into elementary filaments can be realized in a single stage of the process and with a single device, and the more or less complete separation of said elementary filaments can be carried out by means of a supplementary operation more fully directed toward said separation.

The cohesion and mechanical resistance of the nonwoven lap can, moreover, be substantially increased by binding the elementary filaments by thermobonding one or more of them formed of a polymer material with a lower melting point, by calendering with smooth or engraved hot rollers, by passage through a hot-air tunnel oven, by passage over a through-cylinder, and/or by the application of a binding agent contained in a dispersion, solution, or in the form of a powder.

In a variant, consolidation of the lap can also be realized, for example, by hot calendering, prior to any separation of the unitary composite filaments into elementary filaments or microfilaments, said separation being effected after consolidation of the lap.

Additionally, the structure of said lap may also be consolidated by chemical (as described in French patent 2546536 [filed] in the applicants name) or thermal treatment, resulting in controlled shrinkage of at least part of the elementary filaments, after having, where appropriate, realized the separation of the latter, resulting in shrinkage of the lap in the direction of its width and/or in the direction of its length.

Moreover, and according to an additional characteristic of the invention, the nonwoven lap may, after consolidation, be subjected to a binding or dyeing and finishing treatment of a chemical nature, such as anti-pilling, hydrophilic treatment, or antistatic treatment, improvement of its fire resistance and/or modification of its feel or luster, or a mechanical nature, such as napping, sanforizing, emerizing, or passing it through a tumbler, and/or of a nature that modifies external appearance, such as dyeing or printing.

The nonwoven lap described above may notably be used as a:

visible component in elements used for covering automobile interiors;

textile for interior or exterior furnishings;

textile for the fabrication of lining surfaces and the intermediate layers of shoe components, and for the manufacture of the exterior parts and linings of luggage and handbags;

textile for the fabrication of clothing or clothing linings;

textile for the fabrication of cloths and composite products for domestic and industrial cleaning, as well as for clean rooms;

substrate for the realization of filters or filter membranes;

product for the realization of synthetic leathers.

The invention will now be described in detail through the use of several practical examples of its realization, indicated in a non-limiting manner.

EXAMPLE 1

A lap of continuous bicomposite filaments is realized of polyethylene terephthalate/polyamide 6.

The materials used have the following characteristics:

| | POLYESTER | POLYAMIDE |
|---|---|---|
| type | polyethylene terephthalate | polyamide 6 |
| intrinsic viscosity | 0.64 | 2.6* |
| $TiO_2$ | 0.4% | 1.7% |
| melting point | 256C | 222C |
| melt viscosity | 190 Pa · s at 290C | 170 Pa · s at 265C |
| source | Rhone Poulenc | Nylstar |

*Viscosity: 1% concentration in 96% sulfuric acid at 20C.

As shown in FIG. 8 of the attached drawings, spinning unit 1 consists of two chambers, one of which is located along the axis of said unit (PA6 spinning) with the second, circular in form, encircling the first (PET spinning).

Polymer distribution is provided by five intermediate plates, of which:

two distribution plates 2 are intended to mix the flow from the two chambers;

three plates 3 are intended for the distribution itself.

The two distribution plates provide both circular and radial distribution.

Stacking of the three final distribution plates permits cellular feeding of each of the die holes. Each of said holes thus has its own feed circuit and can spin a unitary composite filament.

The die itself consists of 180 capillary holes 0.28 mm in diameter and 0.56 mm in length. A schematic representation of an orifice of one such die is reproduced in FIG. 10 of the attached drawings.

The extrusion temperatures of the two polymers are respectively 295C for PET and 255C for PA6, the spinning vat itself being at a temperature of 278C, the spinning rate approximately 4500 m/min and the throughput per die hole 0.7 g/min (0.35 g/min per polymer).

Drying of PA6 and feeding of the extruder take place in a nitrogen atmosphere and the polymer transfer circuits to the die are designed in such a way that the retention and feed times of said polymers are sufficiently short to avoid any appreciable degradation of the latter.

The process of fabricating this lap is similar, with respect to the conditions for cooling, drawing, and napping, to that described in French patent 7420254.

The nonwoven lap obtained has a weight of 120 g/m$^2$ and consists of continuous non-crimped filaments having a filament number of 1.6 dTex and presenting, in cross-section, a wedge configuration with a central orifice, said wedges or sections being composed alternatively of one of the two aforementioned polymer materials and in direct contact with the adjacent wedges or sections (the structure of the section is comparable to that shown in FIG. 2 of the attached drawings).

Each composite filament consists of six elementary filaments of polyethylene terephthalate with a filament number of 0.15 dTex and six elementary filaments of polyamide with a filament number of 0.11 dTex, resulting in a proportion by weight of polyethylene terephthalate/polyamide 6 of 60/40.

After napping, the aforementioned nonwoven lap is subject to the action of pressurized streams of fluid (water) in order to separate the composite filaments into elementary filaments, and entangle and bind the latter.

The conditions and means of realization of this operation of hydraulic bonding are substantially similar to those described in French patent 2705698 [filed] in the applicants name.

More specifically, said hydraulic bonding consists, successively, in passing the nonwoven lap beneath a first wetting-out rack, in squeezing the wet lap (by passing it between two calendering rollers or by suction, for example), and finally by passing the lap, where it passes the three successive hydraulic binder assemblies, over a suction drum, said assemblies acting respectively on the recto, verso, and recto of the lap, and each comprising three strips or lines of jets spaced 0.6 mm apart.

During the process of hydraulic bonding, the nonwoven lap moves on an 80 mesh metallic screen (80 threads/2.54 cm) with a 70% aperture. The processing speed is in this case approximately 15 m/min.

The aforementioned hydraulic bonding assemblies are adjusted as follows:

First assembly—Recto surface

| line of jets | Line 1 | Line 2 | Line 3 |
|---|---|---|---|
| nozzle diameter ( ) | 100 | 100 | 100 |
| pressure (bars) | 120 | 180 | 180 |

Second assembly—Verso surface

| line of jets | Line 1 | Line 2 | Line 3 |
|---|---|---|---|
| nozzle diameter ( ) | 120 | 120 | 120 |
| pressure (bars) | 230 | 230 | 230 |

Third assembly—Recto surface

| line of jets | Line 1 | Line 2 | Line 3 |
|---|---|---|---|
| nozzle diameter ( ) | 120 | 120 | 120 |
| pressure (bars) | 230 | 230 | 230 |

On exiting the third hydraulic bonding assembly, the nonwoven lap is extracted by compressing it between two calendering rollers, dried in a hot-air cylinder at 160C, and, finally, wound.

The specific characteristics and properties of this lap are as follows: appearance and texture of a "flannel" type fabric, high breaking load and tear strength, good drapeability and resistance to abrasion.

The lap obtained by the aforementioned process, which forms a nonwoven fabric, can be advantageously used, after dyeing or printing and possibly embossing, as an interior covering for automobile partitions or wall coverings.

EXAMPLE 2

A nonwoven lap is realized of continuous filaments according to a process similar to that described in example 1, said lap being subjected to a hydraulic bonding process identical to that previously described.

The lap obtained has a weight of 130 g/m$^2$ and is subjected, consecutively, to hydraulic bonding, needle calendering by means of two heated metal rollers, namely an engraved roller at 232C and a smooth roller at 215C (pressing force: 50 daN/cm of width, speed: 15 m/min, 52 teeth/cm2, percentage of surface bound: 13%).

This additional treatment of the lap results in an increase of its resistance to deformation and abrasion.

The lap obtained can be advantageously used for pigment printing or, after dyeing, as a visible covering for automobile door panels, as a covering for injected or molded parts designed to be mounted inside vehicle interiors, for the fabrication of interior linings of shoes, or the fabrication of work clothes.

In a variant said lap can also be used, after printing (notably of the "fixed-washed" type), to make draperies or curtains for interior furnishings.

EXAMPLE 3

A lap is made of crimped continuous composite filaments, composed of polyethylene terephthalate/polyamide 66 polymer materials, present in identical amounts by weight.

The PET used is identical to that in example 1.

The polyamide 66 (PA66) is of the type known by the name 44AM30 from Rhone Poulenc (melt viscosity: 170 Pa.s and IV 137).

The melting and spinning temperatures are 285C for both polymers and the metering pumps used have a flow of 10 cm$^3$ per revolution.

The feed and distribution system of the spinning unit is similar to that described in example 1.

Each die has 180 holes with external diameter of 1.35 mm and internal diameter of 1.0 mm, off-centered. This arrangement results in a circular slot whose width varies with the circumferential position (the half-circumference, for example) and can be realized by anticipating and cutting out two semi-circular disks of different radii, resulting in a circular slot with a half-circumference of 0.15 mm in width and whose other half-circumference is 0.2 mm in width (see FIG. 9 in the attached drawings).

The cooling system arranged beneath the die is circular in shape and blows cool air at 17C and 80% RH, at a rate of 0.8 m/s.

The drawing and napping system is similar to that described in French patent 7420254 [filed] in the applicants name.

The crimped continuous composite filaments have twelve crimps per centimeter and a crimp rate of 180%.

The nonwoven lap obtained has a weight of 140 g/m$^2$ and consists of composite filaments with a filament number of 1.6 dTex and displaying a wedge-like cross-sectional configuration with an off-center opening, resulting in asymmetric behavior of the composite filament and the formation of elementary filaments with different filament numbers.

Said lap is subjected to hydraulic bonding (using the same assemblies as in example 1 but with a pressure of 180 bars for the second and third assemblies), followed by a chemical shrinkage process as described notably in French patent 2546536 [filed] in the applicants name.

The bath is raised to a temperature of 18C and contains 64% formic acid.

Contact time of the lap in the bath is approximately 25 seconds and the bath is followed by successive operations of rinsing in water at room temperature, extraction, and drying at 120C.

The lap is then impregnated with a solution of polyurethane in dimethylformamide (025/70H polyurethane from COIM, present in a concentration of 14%), followed by coagulation of the polyurethane by passing the lap through a bath of dimethylformamide/water (20/80) at 60C.

After drying there is approximately 16% of dry polyurethane in the fibrous mass of the lap.

Finally, the lap is also subjected, consecutively, to operations of emerizing and dyeing, primarily high-temperature "Jigger" type dyeing.

The nonwoven product, with a weight of 172 g/m$^2$, obtained by the process described above is similar in its properties and appearance to a leather and can be advantageously used for the production of shoes, leather products and handbags, coverings for seats and furnishings, and for the production of seat coverings and automobile interiors.

EXAMPLE 4

A continuous lap of filaments is made having a fiber constitution identical to that described in example 3 but with a latent crimp.

To generate a significant crimp, the unitary composite filaments are preferentially spun at a speed of approximately 3200 m/min and subjected, after napping, to a hydraulic bonding operation under conditions that are appreciably similar to those described in example 3.

Following hydraulic bonding, the lap is subjected to drying and heat treatment between 160C and 180C (temperature below the discoloration temperature of the polyamide polymer), resulting in the appearance or activation of the latent crimp and shrinkage of said lap, the time the lap is subject to heat treatment being less than one minute.

To this end a clip tenter frame is used that grabs said lap by pinching it near each longitudinal lateral edge, said clips having a configuration when seen from above in the shape of a V (the opening between the lateral clips narrows in the direction of movement of the lap). By implementing such a clip tenter frame (one that narrows in the direction of its outlet) and by overfeeding the lap in the longitudinal direction at the entrance to the tenter frame, we obtain a retraction of said lap in the direction of its length as well.

The rate of retraction of the free filaments at 180C is approximately 50% to 60%, which results in a rate of retraction for the lap of 12% to 15% (in the longitudinal and cross-wise directions) and an increase in weight of 30% to 35%.

The retracted lap is then subjected to additional treatments identical to those described in example 3 (from the point at which it is impregnated with a polyurethane solution) and may be used in applications similar to those described in that example.

EXAMPLE 5

A lap of bicomposite continuous filaments of polyethylene terephthalate/polybutylene terephthalate is made.

The structure of the spinning unit used in this example is appreciably similar to that of the spinning unit used in example 3, with the presence of two distribution plates designed to mix the flows and three distribution plates whose openings are conformed and grouped in the shape of a daisy.

The distribution system is realized on the basis of a coaxial distribution of polymers, but uses a multi-lobe die. The heart, or central element, of each daisy-like structure is fed by the distribution circuit with two PBT and the eight lobes of each daisy-like structure are fed with PET.

The PET used is identical to that used in example 1 with the addition of a small percentage of silicone oil of an organosiloxane type (approximately 0.3%).

The PBT used is a type known as TQ9/04, made by ENICHEM, and has a melt viscosity of 290 Pa.s at 265C and contains 0.4% $TiO_2$.

The extrusion temperatures are respectively 290C (PET) and 260C (PBT), and the temperature of the spinning vat is approximately 280C.

The circular cooling device blows air at 20C and 75% RH with a velocity of 1.2 m/s.

The die/drawing nozzle distance is approximately 1.1 meters for a spinning speed of 5600 m/min.

The rate per die hole is 0.9 g/min for PET and 0.11 g/min for PBT.

The nonwoven lap obtained has a weight of 145 g/m$^2$ and consists of continuous non-crimped filaments with a filament number of 1.8 dTex and a cross-sectional configuration in the shape of a daisy in which the pistil is formed by a central cylindrical elementary filament of polybutylene terephthalate (filament number 0.2 dTex) and the petals are formed by elementary filaments of polyethylene terephthalate (filament number 0.2 dTex) with an elongated elliptical cross-section arranged circumferentially around said central elementary filament by being adjacent to the latter near one of the extremities of the ellipse delimiting the contour of said peripheral elementary filaments in cross-section (see FIG. 7).

Said peripheral elementary filaments of elongated elliptical cross-section consist preferentially of polyethylene terephthalate with the addition of silicone, as described principally in French patent 2657893 [filed] in the applicants name.

The injected silicone (approximately 0.3% by weight of polyethylene terephthalate) serves to lubricate the drawing of the peripheral elementary filaments and, by partially migrating at least to the surface of said peripheral elementary filaments, forms the interfaces between the latter and the central elementary filament, which appreciably facilitates the separation of composite filaments into elementary filaments (energy needed for the weakest separation). However, the amount of silicone must be relatively limited so as not to disturb subsequent treatments (notably finishing), dyeing or printing.

After formation of the nonwoven lap into composite continuous filaments, the latter is subjected to mechanical needle-punching, followed by hydraulic bonding, resulting in at least partial separation of the different elementary filaments.

Said lap is then subjected to local calendering at a temperature between the melting points of the two polymers, that is, between 256C (melting point of PET) and 226C (melting point of PET), in such a way as to melt the PBT and create solid local bonds between the elementary PET filaments.

The nonwoven product resulting may be used, after pigment printing, as a substrate for the production of cushions, garden chairs, beach umbrellas, and tablecloths.

The aforementioned nonwoven product can also be used, after dyeing or printing (notably by means of a process of the "fixed-washed" type) for the realization of interior coverings for automobiles, sport and casual shoe uppers, luggage, or leather goods.

EXAMPLE 6

A lap of tricomposite continuous filaments is formed of polyethylene terephthalate, polyamide 6, and polypropylene, with respective total filament numbers of 1.08 dTex, 1.08 dTex, and 0.24 dTex.

The die unit is composed of a circular chamber for the polypropylene and two symmetric axial chambers for the polyamide 6 and the polyethylene terephthalate.

The polymer distribution system is composed of three flow intersection plates and the separation system is composed of three cellular distribution plates similar to those used in example 3.

The MFI 25 polypropylene is extruded at 250C and the extrusion conditions for polyamide 6 and polyethylene terephthalate are identical to those in example 1.

Additionally, the polypropylene is charged with 1% titanium dioxide, introduced into the extruder feed, and the spinning speed is approximately 5000 m/min.

The nonwoven lap obtained has a weight of 90 g/m$^2$ and consists of crimped continuous composite filaments with a filament number of 2.4 dTex and a cross-sectional configuration in wedges with an off-center orifice (see FIG. 3).

The separation of composite filaments into elementary filaments is carried out during a hydraulic bonding operation.

It should be pointed out that the incompatibility of the different constituent materials can be used to limit the energy needed for separation (which is carried out using a pressure of approximately 100 bars at the nozzles of the devices). This limitation of the energy of separation is further accentuated by the different nature of the materials and the slight swelling of the polyamide 6 in the presence of water.

The lap is then subjected to drying at 180C on a through-cylinder, during which time the elementary polypropylene filaments undergo complete or partial melting depending on the contact time (greater than approximately 12 seconds).

This melting of the polypropylene filament component results in a close bond between the elementary filaments of polyethylene terephthalate and polyamide 6.

The nonwoven product thus obtained simultaneously displays a very absorbent structure, due to its high capillarity, and good resistance to repeated use in household and industrial cleaning and drying applications. Moreover, the aforementioned product resists (in terms of structural cohesion and pilling) repeated washing in water at 50C and dry cleaning (possibility of repeated use of the product and cost savings).

In addition, such a product, as a result of its constitution in the form of continuous filaments and excellent cohesion resulting from hydraulic bonding and thermobonding, has the advantage of not emitting fibrous particles during use. This property is very important for its use as a cleaning substrate in clean rooms and electronics applications.

EXAMPLE 7

A 120 g/m$^2$ lap is realized consisting of bicomposite filaments of 1.6 dTex as described in example 3 and monoconstituent polyester filaments of 1.6 dTex spun together in the same die with a proportion of 80% crimped biconstituent filaments of polyamide 66 and polyethylene terephthalate and 20% pure uncrimped polyester terephthalate filaments, resulting in a multidenier structure after separation of the constituents of the biconstituted filaments by the action of high-pressure water streams (identical to example 1).

This lap is then subjected to local calender bonding by means of engraved metal rollers at a temperature of 238C and a counterpart consisting of a smooth metal roller at a temperature of 223C (pressing force: 50 daN/cm of width, speed: 22 m/min, 55 teeth/cm2, percentage of bound surface. 17%).

The possibility also exists of introducing colorants dispersed in the form of master batches in the polyamide polymer and polyethylene terephthalate materials during extrusion to obtain mass-colored products whose coloration shows excellent resistance to light and wear.

The bicomposite and monoconstituent filaments can be extruded from the same die or from two distinct dies in succession, the extruded filaments being subsequently blended at the drawing station.

The nonwoven fabric obtained combines very good mechanical properties, tear resistance in particular, with good appearance, flexibility, drape, and resilience, making it particularly apt for the production of work clothes.

EXAMPLE 8

Using the crimped continuous filaments described in example 6, a nonwoven lap weighing 120 g/m$^2$ is made directly by means of a napping system in 8 unitary laps of 15 grams each, successively deposited on top of one another according to the process described in French patent 7420254. Between layers 4 and 5 is introduced a stabilized weft-knit textile weighing 20 g/m$^2$ made of polyamide 6.

The stratified assembly is bound by means of a hydraulic bonding device comprising high-pressure water jet racks (250 bars) successively over the two sides, leading to the separation of strands and the entanglement of the microfilaments formed by the individual elementary filaments and the aforementioned textile reinforcement in a very cohesive manner.

The three-layer assembly is then dried at 180C to melt the polypropylene microfilaments that serve as a binder.

The resulting nonwoven fabric can be dyed or printed by conventional methods and then treated in a tumbler to improve its feel and flexibility.

The properties of this flannel-like fabric very favorably combine the mechanical characteristics, appearance, flexibility, drape, wear resistance, and reduced bagging due to the textile reinforcement used, for the realization of casual wear clothing such as casual-wear and sports jackets, or interior clothing such as bathrobes.

EXAMPLE 9

A bicomposite filament lap is made as described in example 3, except that the weight is 32 g/m$^2$ and it is bound by means of a hydraulic bonding process-by treating the two surfaces (the pressures used are identical to those used in example 1, with a pay-off speed of 65 m/min). This nonwoven is covered by means of the powder coating method (16 g/m$^2$) using a terpolyamide powder (PA66, 612) with a melting point of 120C (see DE-PS-3610029, example 1).

The product obtained has very good flexibility and good elasticity, and resists dry cleaning well. This product can be advantageously used as a thermobonding lining for clothing.

EXAMPLE 10

A multilayer lap with a total weight of 140 g/m$^2$ is made, formed of five layers (70 g/m$^2$) of filaments of the same type as those realized in example 1 and five other layers (70 g/cm$^2$) consisting of bilaminated crimped filaments with a filament number of 1.5 dTex and formed of polyethylene terephthalate and polybutylene terephthalate (as described in French patent 2705698).

Hydraulic bonding is then carried out as described in the previously cited French patent, followed by smooth calendering between a hot roller at 225C (in contact with the nonwoven side similarly constituted to that described in example 1) and a cold roller at 125C, at a speed of 18 m/min and a pressing force of 25 daN/cm of calender width.

The product obtained may be advantageously used in filtration applications, notably for draining milk or filtering food oil.

The characteristics and properties of the products obtained in the aforementioned examples 1 to 3 and 7 are summarized in the following table.

| Measurement | Unit | Method | Example 1 | Example 2 | Example 3 | Example 7 |
|---|---|---|---|---|---|---|
| Mass per unit area | $g/m^2$ | NFG 38013 | 120 | 130 | 140 | 120 |
| Thickness | mm | NFG 38012 | 0.63 | 0.55 | 0.8 | 0.78 |
| Breaking load sL/sT | daN/5cm | NFG 07001 | 43.0/32.0 | 38.0/25.7 | 31.0/33.6 | 46.4/37.6 |
| Isotropy | — | — | 1.34 | 1.48 | 0.92 | 1.23 |
| Elongation sL/sT | % | NFG 07001 | 73/85 | 56.2/72.8 | 65.0/75.1 | 65.1/83.0 |
| Load at 3% sL/sT | daN/5cm | NFG 07001 | 2.1/0.55 | 5.52/0.98 | | |
| Load at 5% sL/sT | daN/5cm | NFG 07001 | 3.5/0.87 | 8.1/1.6 | | |
| Load at 15% sL/sT | daN/5cm | NFG 07001 | 10.8/3.2 | 16.7/5.15 | | |
| Energy at break sL/sT | J | NFG 07001 | 41.5/25.3 | 28.8/19.2 | | |
| Thermal contraction sL/sT | % | 180C - 15 min | −0.6/−0.4 | −1.5/0.2 | −0.1/−1.2 | −1.1/−1.4 |
| [Mass load per unit volume] % (5 × 5 cm) | % | | 3.7 | 3.0 | 4.1 | 3.5 |
| Tear strength sL/sT | daN | NFG 07146 | 2.4/3.6 | 1.8/3.4 | 2.7/3.2 | 2.8/3.0 |
| Load per unit area ((L + T) /2) /mas s per unit area | daN/g/m2 | | 3.1 | 2.45 | 1.92 | 3.5 |
| Initial modulus calc[ulated] → lm(tangent load at 3%) | MN/m | | 4.1 | 11.0 | 4.3 | 6.8 |
| Abrasion resistance | cycle number | Martindale ITF | 50,000 | 50,000 | 50,000 | 500,000 |
| (9kPa) Load loss | % | BS 5690 | −10.5 | −6.6 | −4.8 | −7.1 |
| Porosity (5cm - 196 Pa) | $1/m^2/s$ | NFG 07111 | 555 | 272 | 124 | 189 |
| Coefficient of drapeability | | NFG 07109 | 0.91 | 0.82 | 0.95 | 0.64 |

Of course, the invention is not limited to the embodiments described and represented in the attached drawings. Modifications remain possible, notably from the point of view of the constitution of various elements or the substitution of technical equivalents, while remaining within the inventions field of protection.

What is claimed is:

1. A nonwoven lap of continuous filaments having a density of 5 $g/m^2$ to 600 $g/m^2$and comprised of composite filaments separable in the direction of their length, said composite filaments having a filament number between 0.3 dTex and 10 dTex, and are each formed of at least three elementary filaments of at least two different polymer materials, each elementary filament having a filament number between 0.005 dTex and 2 dTex, wherein the ratio between the cross-sectional area of each elementary filament to the total cross-sectional area of the unitary filament is between 0.5% and 90%, and wherein the composite filaments have a longitudinal hollow tubular cavity centered or not with respect to the median axis of said composite filaments.

2. The lap according to claim 1, wherein the composite filaments have a filament number greater than 0.5 dTex and each elementary filament has a filament number less than 0.5 dTex.

3. The lap according to claim 1, wherein the composite filaments have a filament number between 0.6 dTex and 3 dTex and the elementary filaments have filament numbers between 0.02 dTex and 0.5 dTex.

4. The lap according to claim 1, wherein the different polymer materials forming the composite filaments are distributed in distinct zones within the cross-section of the latter in such a way as to permit their separation into elementary filaments each corresponding, in cross-section, to one of said zones.

5. The lap according to claim 1, wherein the different polymer materials constituting the composite filaments are immiscible or incompatible among themselves.

6. The lap according to claim 5, wherein the group of polymer materials forming the elementary filaments is selected from among the group consisting of: (polyester/polyamide), (polyamide/polyolefin), (polyester/polyolefin), (polyurethane/polyolefin), (polyester/polyester modified by at least one additive), (polyamide/polyamide modified by an additive), (polyester/polyurethane), (polyamide/polyurethane), (polyester/polyamide/polyolefin), (polyester/polyester modified by at least one additive/polyamide), (polyester/polyurethane/polyolefin/polyamide).

7. The lap according to claim 1, wherein the composite filaments have, in cross-section, a configuration of zones representing the cross-sections of different elementary filaments in the form of wedges or sectors.

8. The lap according to claim 7, wherein the wedges or sectors, forming the cross-sectional pattern of the composite filaments have different dimensions.

9. The lap according to claim 1, wherein the elementary filaments are integrated in a surrounding matrix of a material that is easily separable or dissolvable, the material of said matrix also being present in interstices separating said elementary filaments.

10. The lap according to claim 1, wherein the outside contours of the cross-sections of the composite filaments have a multi-lobe configuration, defining several sectors or zones.

11. The lap according to claim 10, wherein the elementary filaments have, in cross-section, a configuration in the shape of a daisy whose pistil is formed of an elementary filament and whose petals are formed by the other elementary filaments, each forming said composite filaments.

12. The lap according to claim 1, wherein the composite filaments have a latent or spontaneous crimp resulting from an asymmetry of behavior of said filaments with respect to their longitudinal median axis, said crimp being activated or accentuated by an asymmetry in the geometry of the configuration of the cross-section of said composite filaments.

13. The lap according to claim 1, wherein the composite filaments have a latent or spontaneous crimp resulting from a differentiation of the physical properties of the polymer materials forming the elementary filaments resulting in distortions generated by asymmetric internal constraints with respect to the longitudinal median axis of said composite filaments, said crimp being activated or accentuated by an asymmetry in the geometry of the configuration of the cross-section of said composite filaments.

14. The lap according to claim 1, wherein the composite filaments have a latent crimp that is activated by thermal, mechanical, or chemical treatment before the formation of the nonwoven lap.

15. The lap according to claim 12, wherein the crimp is accentuated by an additional thermal or chemical treatment of the lap.

16. The lap according to claim 1, wherein it is composed of several nonwoven layers on top of one another.

17. The lap according to claim 16, wherein each layer is constituted of filaments from a single die.

18. The lap according to claim 16, wherein at least one layer is constituted of filaments from at least two distinct dies.

19. The lap according to claim 16, wherein at least one of the layers constituting said lap is constituted of filaments that differ from those of at least one other of said constitutive layers.

20. A nonwoven lap composed of several nonwoven layers on top of one another, wherein each layer is comprised of continuous filaments having a density of 5 $g/m^2$ to 600 $g/m^2$ and comprised of composite filaments separable in the direction of their length, said composite filaments having a filament number between 0.3 dTex and 10 dTex, and are each formed of at least three elementary filaments of at least two different polymer materials, each elementary filament having a filament number between 0.005 dTex and 2 dTex, wherein the ratio between the cross-sectional area of each elementary filament to the total cross-sectional area of the unitary filament is between 0.5% and 90%, and wherein at least one of the layers constituting said lap is constituted of filaments that differ from those of at least one other of said constitutive layers.

21. A nonwoven lap of continuous filaments having a density of 5 $g/m^2$ to 600 $g/m^2$ and comprised of composite filaments separable in the direction of their length, said composite filaments having a filament number between 0.3 dTex and 10 dTex, and are each formed of at least three elementary filaments of at least two different polymer materials, each elementary filament having a filament number between 0.005 dTex and 2 dTex, wherein the ratio between the cross-sectional area of each elementary filament to the total cross-sectional area of the unitary filament is between 0.5% and 90%, and wherein composite filaments from at least two distinct dies are present in said nonwoven lap.

* * * * *